US005718057A

United States Patent [19]

Rösli et al.

[11] Patent Number: 5,718,057

[45] Date of Patent: Feb. 17, 1998

[54] REGISTER DRAW-IN DEVICE

[75] Inventors: Manfred Rösli, Herisau; Hanspeter Gietz, Gossau, both of Switzerland

[73] Assignee: Maschinenfabrik Gietz AG, Gossau, Switzerland

[21] Appl. No.: 545,330

[22] Filed: Oct. 20, 1995

[30] Foreign Application Priority Data

Oct. 21, 1994 [CH] Switzerland ..... 3161/94

[51] Int. Cl.[6] ..... B65H 7/02; B65H 9/00

[52] U.S. Cl. ..... 33/617; 33/614; 101/DIG. 36

[58] Field of Search ..... 33/1 G, 1 K, 1 M, 33/614, 617, 619, 620, 621, 623, 645; 101/DIG. 36; 271/226, 234

[56] References Cited

U.S. PATENT DOCUMENTS

| | | | |
|---|---|---|---|
| 635,061 | 10/1899 | Sabel | 33/621 |
| 724,116 | 3/1903 | Maley | 33/617 |
| 1,620,343 | 3/1927 | Hacker | 33/614 |
| 3,921,974 | 11/1975 | Miciukiewicz | 271/240 |
| 4,827,626 | 5/1989 | Wieland | 33/614 |
| 5,129,155 | 7/1992 | Hoffman et al. | 101/DIG. 36 |
| 5,226,366 | 7/1993 | Schlife et al. | 101/DIG. 36 |
| 5,322,273 | 6/1994 | Rapkin et al. | 271/227 |

FOREIGN PATENT DOCUMENTS

| | | |
|---|---|---|
| 0 532 343 | 3/1993 | European Pat. Off. . |
| 2 047 625 | 12/1980 | United Kingdom . |

*Primary Examiner*—G. Bradley Bennett
*Attorney, Agent, or Firm*—Walter C. Farley

[57] ABSTRACT

A register draw-in device for sheet printing and embossing machines has two front or leading edge stops and a side stop, and position sensors (S1, S2, S3) for detecting print marks (P1, P2, P3) of a sheet (5). Two detectors (D1, D2) associated with the front stops (A1, A2) detect the sheet leading edge. The front stops are adjustable by control elements (M1, M2) until front print marks (P1, P2) on the sheet are detected by sensors (S1, S2). A control element (M3) then adjusts the side stop (A3) until a side print mark (P3) is detected by another sensor (S3). A system control (11) controls this register correction with the position sensors (S1, S2, S3), the detectors (D1, D2) and the control elements (M1, M2, M3). This accomplishes reliable automatic register correction for each individual sheet and therefore maximum print quality.

21 Claims, 5 Drawing Sheets

REGISTER DRAW-IN DEVICE

FIELD OF THE INVENTION

The invention relates to a register draw-in device for sheet printing presses and embossing machines with leading edge stops and side stop or side sliding plate.

BACKGROUND OF THE INVENTION

If a sheet with a first print image from a preceding printing process is to be provided in a subsequent printing or embossing process with a second print image or embossed subject, then for each individual sheet the position of the second image must be precisely matched with the first image and completely coincide therewith. However, in practice various resister errors can occur, so that the second print image is displaced with respect to the first. Thus, the first print image, whose position is defined by print marks, is not precisely oriented with respect to the sheet edges and in particular all the sheets do not have the same resister errors and instead the errors can vary from sheet to sheet.

These register errors occur e.g. on cutting the sheet from a web printing press or in a first printing process in a sheet-fed press if, due to operating errors, imprecise settings or operating problems, differences occur in the image spacing with respect to the sheet edges. Particularly when high quality demands are made, e.g. in embossing foil printing, hologram transfer, blind embossing, cold or hot punching and creasing or applying a second print image such register errors represent a serious problem. In particular sloping leading edges with an angular deflection with respect to the print mark positions, have hitherto proved uncorrectable.

Hitherto the register has been set in fixed manner and in optimum form by hand at the start of a printing or embossing process and undergoes no further change during said process. At best in the case of very slowly and continuously occurring deviations, these can be manually readjusted to a very limited extent. However, it has not hitherto been possible to correct accurately on a single sheet basis.

SUMMARY OF THE INVENTION

Accordingly, an object of the present invention is to provide a register device, which for each sheet in an individual, optimum and automatic manner corrects all register errors and in particular sloping leading edges with angular errors and as a result permits perfectly coinciding printing and embossing images with a constant maximum quality. In addition, this is performed by a relatively simple and reliably functioning method.

This is achieved by a register draw-in device wherein the arrival of the sheet at the two leading edge stops is detected with position detectors and then both stops are moved in the running direction X until the front print marks have arrived at their desired positions and consequently the leading edge is oriented in faultless manner. The sheet is then moved transversely by the side stop or side sliding plate until the side print mark has also reached its desired position, so that all the print marks are now in the desired positions, i.e. the leading edge and side edge are oriented in fault-free manner. The sheet is then engaged in a defined manner with the gripper beam and drawn for further processing into the printing or embossing machine. Thus, the embossed subject corresponds precisely with the first print image, so that maximum quality can be obtained for each individual sheet.

BRIEF DESCRIPTION OF THE INVENTION

The invention is described in greater detail with reference to the attached drawings, wherein.

Figure 5A:
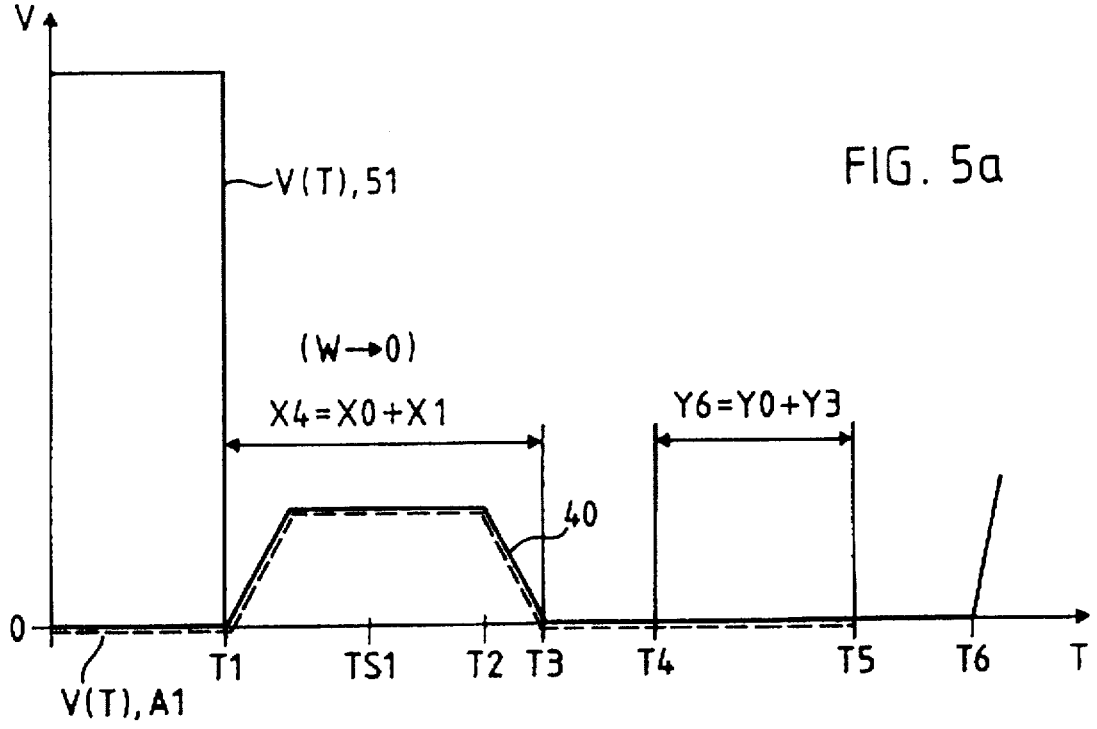
Figure 5B:
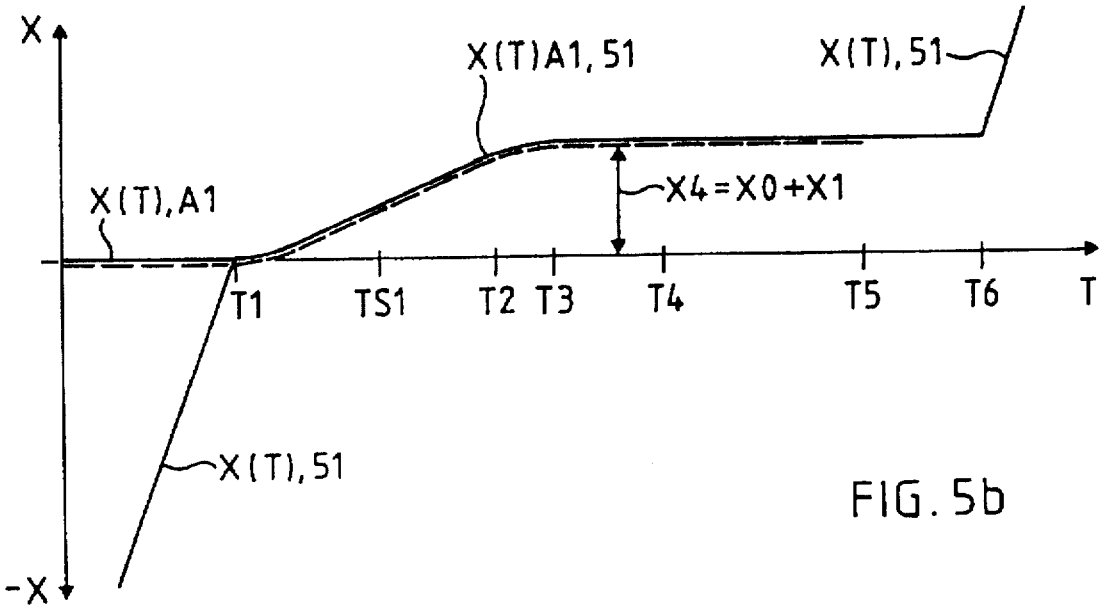

FIGS. 5*a* and 5*b* are graphical illustrations of time sequences of the displacements and the displacement speeds when orienting a sheet into the desired position.

Figure 6A:
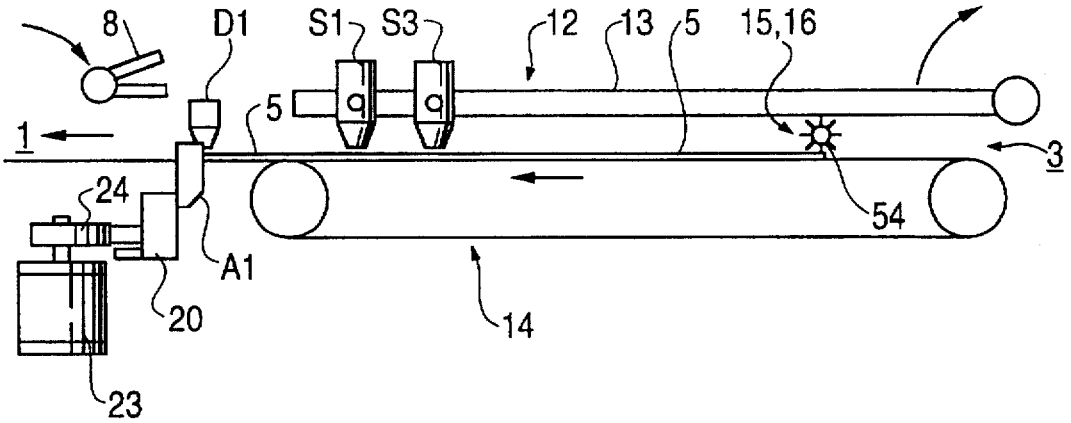
Figure 6B:
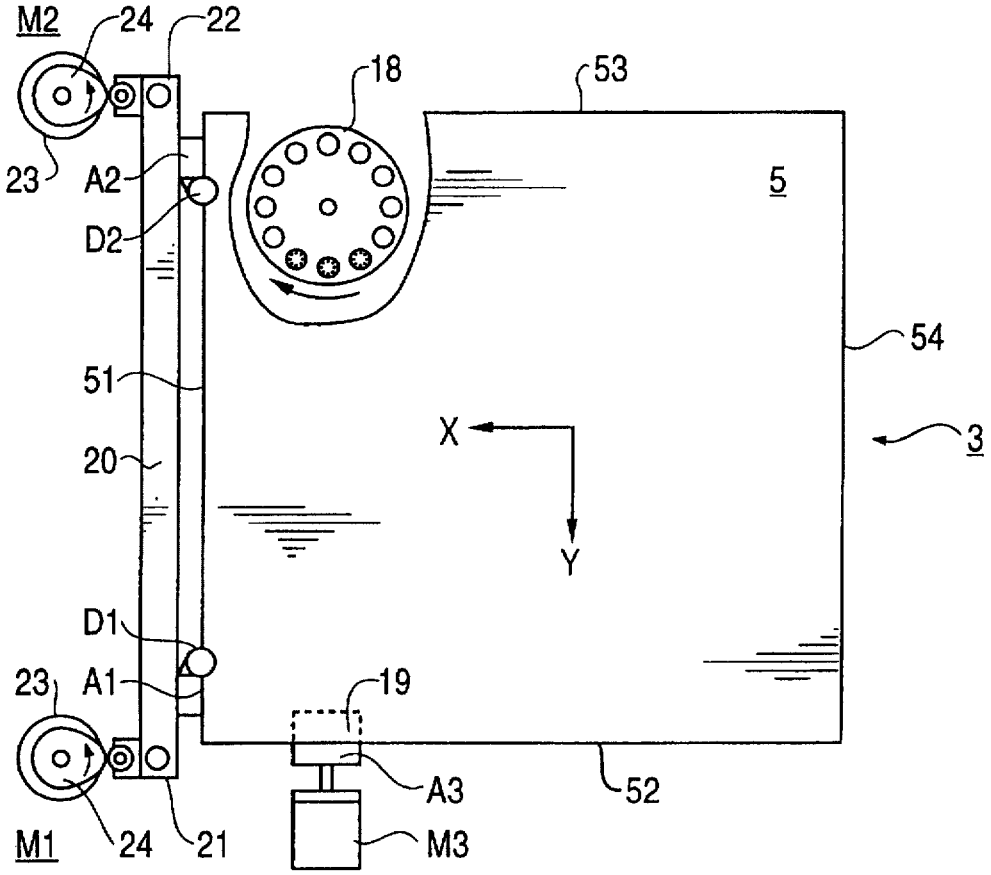

FIGS. 6*a* and 6*b* are side elevation and top plan views of an embodiment of an apparatus in accordance with the invention.

Figure 7:
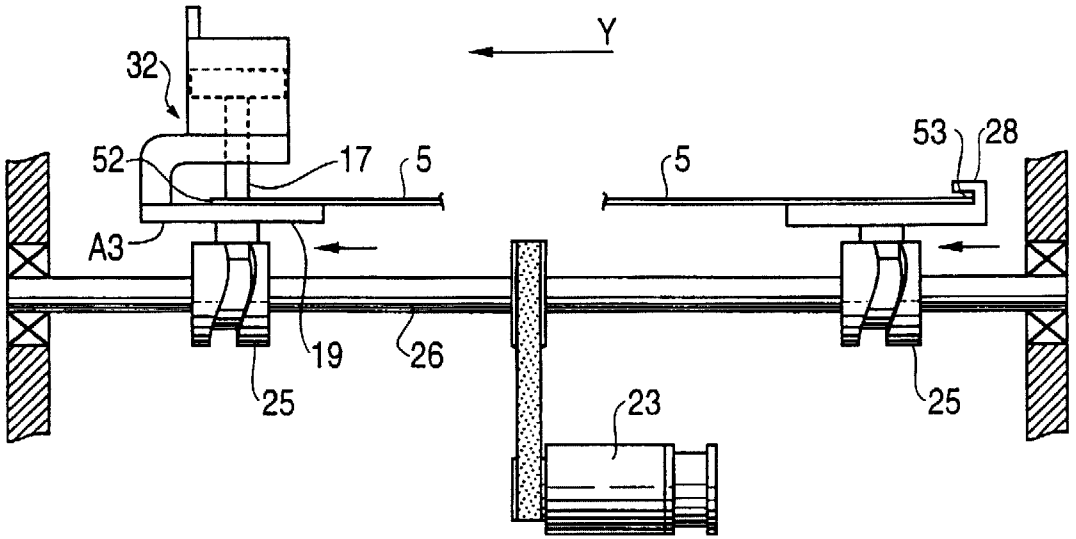

FIG. 7 is an end view of part of an apparatus in accordance with the invention showing lateral displacement with a pulling and pushing stop.

Figure 8:
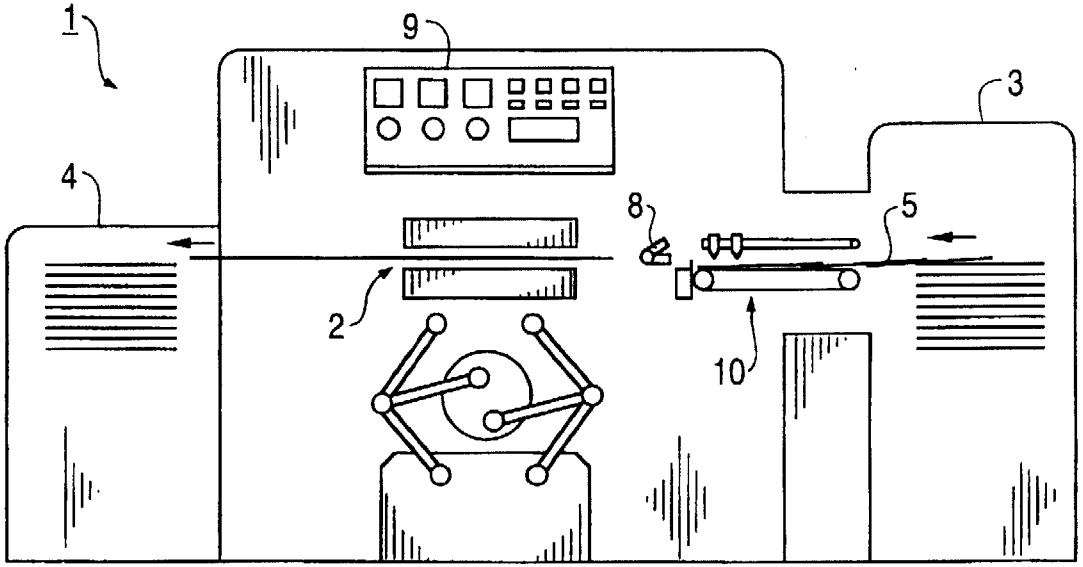

FIG. 8 is a side elevation of a printing/embossing machine with a register draw-in device.

DEFINITIONS

The following definitions are used in conjunction with the drawings:

D1, D2 Leading edge position detectors

A1, A2 Front stops

A3 Side stop or side sliding plate

P1, P2 Print marks relative to the picture front edge

P3 Print mark relative to the picture side edge

P1S, P2S, P3S Faultless desired positions, corrected, position for the further conveying after X4, X5, Y6 displacement S1, S2, S3 Position sensors for reading P1, P2, P3

M1, M2, M3 Control elements associated with the stops A1, A2, A3

X, −X Running directions, reverse direction

Y, −Y Transverse direction

X0, Y0 Zero positions of displacements in the X and Y directions

X1, X2, Y3 Register correction values on stops A1, A2, A3 (=register error, picture edge error, register correction displacement)

YL Entry position fluctuation or correction

X4=X0+X1 Total displacements of the stops A1, A2, A3

X5=X0+X2

Y6=Y0+Y3

Y6=Y0'+Y3+YL (including entry position correction YL)

Y0=Y0'=YL From Y6=Y0+Y3=Y0'+Y3+YL

W Angular errors of an inclined leading edge.

DESCRIPTION OF THE PREFERRED EMBODIMENTS

Figure 1:
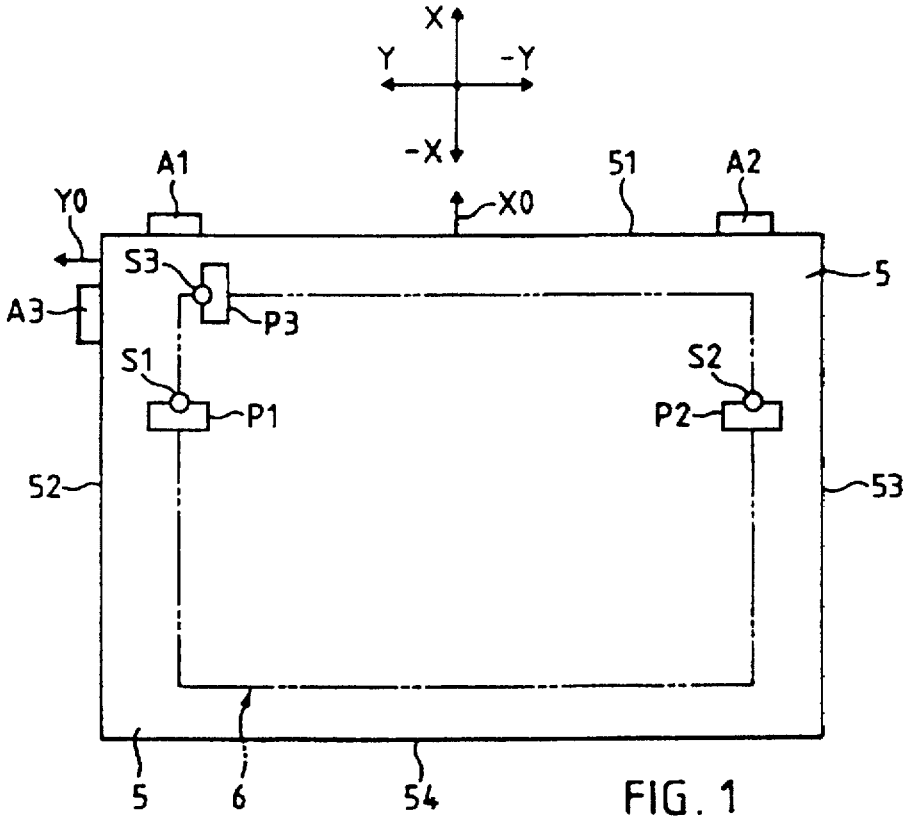
FIG. 1 is a plan view of a position arrangement of print marks, sensors and stops for a faultless reference sheet.

FIG. 1 shows a faultless reference sheet 5 with a leading edge 51, left and right side edges 52, 53 and a trailing edge 54, as well as with a print image The position of the print image is defined by two front print marks P1, P2 for the front image or picture edge and a lateral print mark P3 for the lateral edge of the image or picture. The sheet running direction is designated X, the opposite direction −X, the side direction to the left as Y and to the right as −Y. Position sensors S1, S2, S3 corresponding to the print marks P1, P2, P3 are positioned over the sheet 5, i.e. set to the print marks and attached to a fixed mounting support 12 (see FIG. 6a), so that the faultless reference sheet requires no correction displacements of the stops A1, A2, A3. It is then brought only with a basic displacement of X0 (of the stops A1 and A2 in the X direction) and Y0 (the stop A3 in the Y direction) into its desired position P1S, P2S, P3S for the subsequent further conveying into the printing or embossing machine 1 (FIG. 8).

Figure 2:
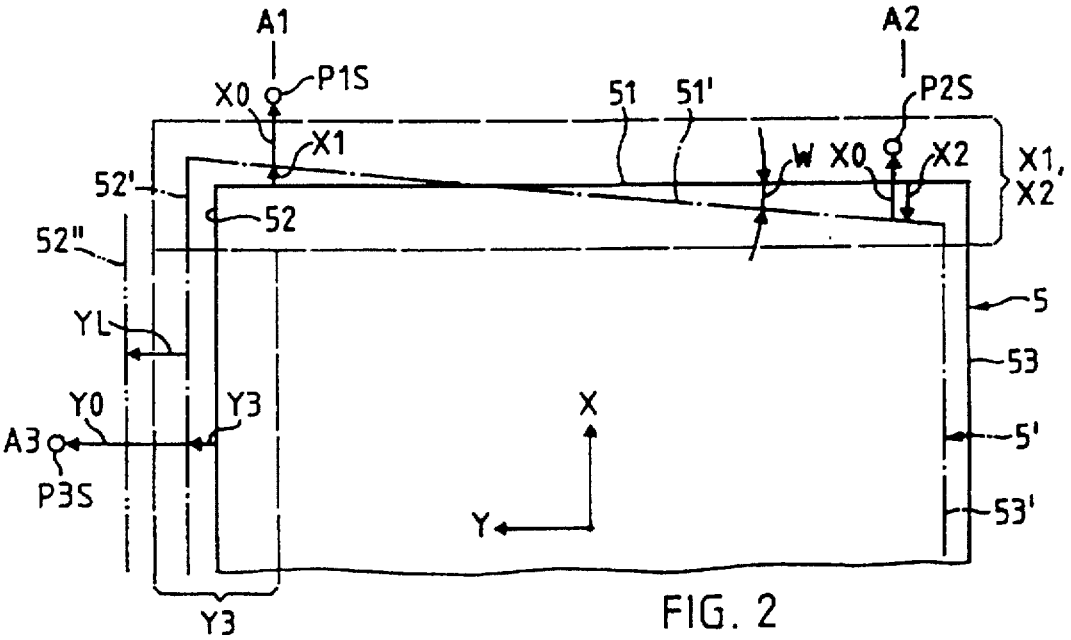
FIG. 2 is a plan view of a faulty faultless sheet and the necessary correction displacements in order to bring it into the desired position.

As is illustrated by FIG. 2, the position of a sloping leading edge 51' with an angular error W and a side edge 52' of a faulty sheet 5' is so corrected by the stops A1, A2, A3, that the sensors S1, S2, S3 once again coincide with these print marks P1, P2, P3 and following any basic displacement by X0, Y0 the faultless desired position P1S, P2S, P3S is reached, so that in a following second printing or embossing process the second print image or embossed subject precisely coincides with the first print image. As an example the faulty, dot-dash sheet 5' shown in FIG. 2 has the following image edge errors:

$$X1=+0.2\ mm$$

$$X2=-0.6\ mm$$

$$Y3=+0.4\ mm$$

i.e. the stops must be displaced by these correction values, so that the print image 5' corresponds to that of the faultless reference sheet 5. In addition to these correction values the front stops A1, A2 are displaced by a basic displacement X0 of e.g. 1 mm and the side stop or sliding plate A3 by a basic displacement Y0 of e.g. 4 mm (if the entry position fluctuation YL=0). The total displacements of the stops A1, A2, A3 are then:

$$X4=X0+X1=1.2\ mm$$

$$X5=X0+X2=0.4\ mm$$

$$Y6=Y0+Y3=4.4\ mm$$

Y6 additionally compensating the entry position fluctuations YL.

Using the example of the sheet edge 52" shown these amount to YL=1 mm for an unchanged image edge error Y3 of 0.4 mm. In order to once again arrive at the same desired position P3S, then 52" must be less displaced by this amount YL=1 mm, i.e. only by Y6'=Y6−YL=3.4 mm.

These adjustment ranges for the displacements, i.e. the maximum possible displacements X4, X5, Y6 are preferably:

for the front stops A1, A2: X4, X5=2 to 6 mm for the side stop or sliding plate A3: Y6=5 to 12 mm and for the register correction ranges X1, X2, Y3: 1 to 3 mm.

With the hitherto known register draw-in devices, entry position fluctuations are eliminated in that the sheet edges 52 are drawn in the Y direction onto a fixed set side stop, corresponding to a basic displacement Y0 for the reference sheet. No basic displacement X0 has taken place on the fixed set front stops in the known methods.

Figure 3:
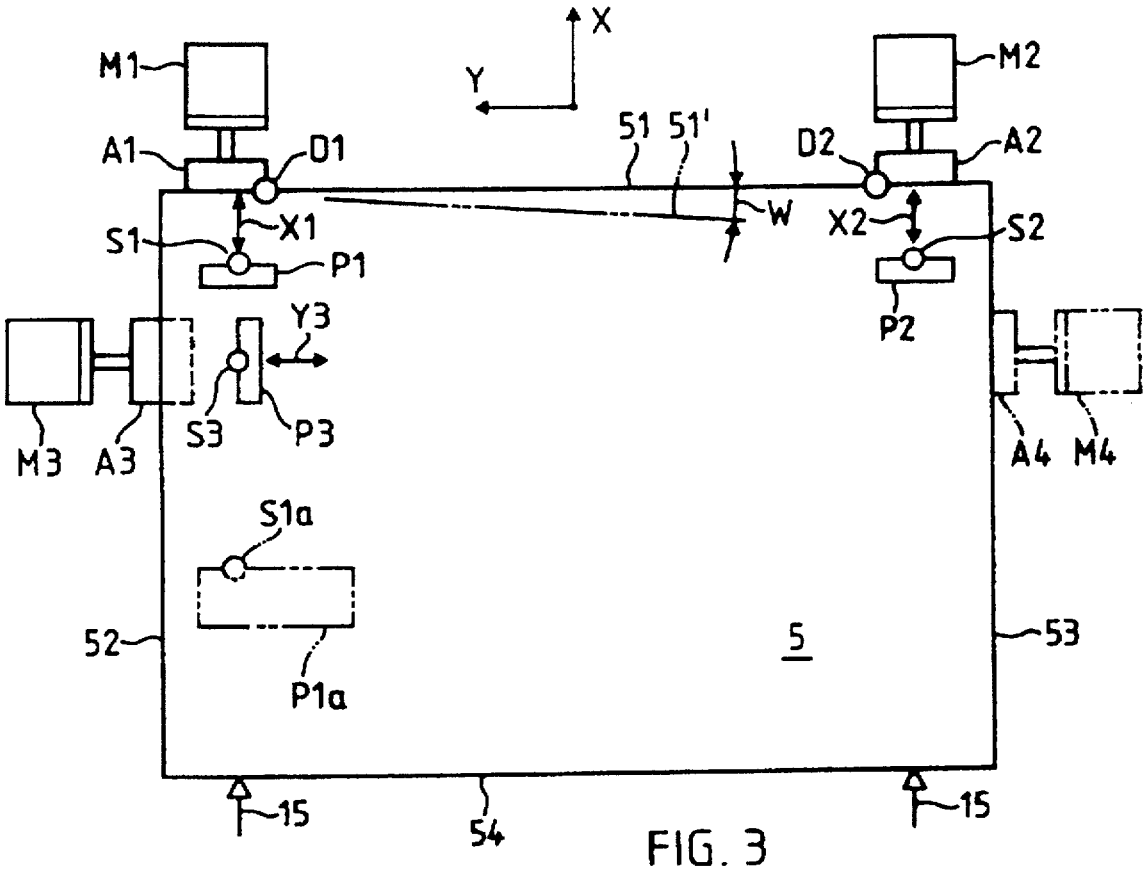
FIG. 3 is a schematic illustration of a register draw-in device according to the invention with position sensors, position detectors and control elements.

FIG. 3 diagrammatically illustrates a register draw-in and correcting device according to the invention and FIGS. 5a and 5b show the associated time sequence in the novel method, the speed path V(T) (FIG. 5a) and the path covered X(T) (FIG. 5b) of the sheet edge 51 and the stop A1 being shown. The sheet runs at a constant speed of e.g. 0.3 m/s in the direction X until it strikes the stop A1 at time T1. The arrival of the sheet edge at the stops A1, A2 is established by position detectors D1, D2 preferably mounted thereon. The stops A1, A2 are now moved until the position sensors S1, S2 detect the associated front print marks P1, P2 at time TS1 or TS2. With the corrections X1 and X2 the angular error W of the faulty, sloping edge 51' is corrected. In the desired position W=0. The stops are then displaced until at stop A1 the displacement X4=X0+X1 and on the stop A2 the displacement X5=X0+X2 is reached and consequently the desired positions P1S and P2S are assumed at time T3. Thus, the correction values X1 and X2 are determined by the times TS1 and TS2. For braking the stops and control elements M1, M2 it is possible to cover a calculated time in braking ramp 40 from T2 to T3. Then, at time T4, the start of the lateral displacement of the stop or sliding plate A3 takes place, e.g. by pulling the sheet in the Y direction until the position sensor S3 detects the associated side print mark P3, so that the side correction value Y3 is determined. The stop A3 is again advanced in calculated manner up to time T5, so that the side displacement Y6=Y0+Y3 is reached and therefore also the desired position P3S is assumed. Then at time T6 the gripper beam 8 (FIG. 6a) trips the now faultlessly oriented sheet in the desired position P1S, P2S, P3S.

The displacement of the front stops can only start when the leading edge 51 has reached both stops A1, A2, or in the case of a non-simultaneous arrival of 51 at A1 and A2, their displacements can also commence individually and in staggered manner as soon as the leading edge 51 has reached the particular stop. During the lateral displacement the sheet 5 is kept by suitable conveying elements 15 (in FIG. 6) in contact with the stops A1, A2.

In FIG. 3 the alternative front mark P1a illustrates that it is also possible to choose any appropriate points of the print image for placement of print marks and the associated sensor (here S1a to mark P1a) is correspondingly set on the mounting support 12 (FIG. 6).

As a further possible variant FIG. 3 shows to the right a side stop A4, which would push the sheet in the Y direction. Unlike this the left stop A3, then e.g. in the form of a clamp slide, pulls the sheet in the Y direction. The stops A1, A2, A3 or A4 are controlled by control elements M1, M2, M3 or M4 and are accurately displaceable to within at least 0.1 mm. The control elements can be constituted e.g. by a.c. servomotors with spindles or racks, as well as linear motors. It is also appropriate to use cam disks 24, 25, as shown in FIGS. 6 and 7, in which the maximum linear displacements in the X or Y direction are given by the cam stroke and are limited.

Figure 4:
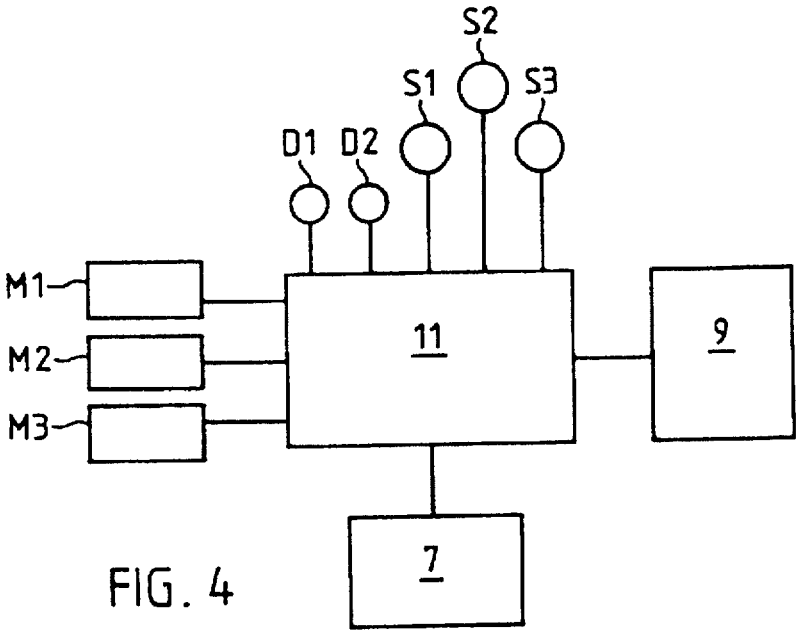
FIG. 4 is a circuit diagram with a system control.

FIG. 4 shows a circuit diagram of the register device according to the invention with a system control 11 having a computer, which is connected to the machine control 7 of a series-connected printing or embossing machine 1 (in FIG. 8), as well as with position sensors S1, S2, S3, position detectors D1, D2 and control elements M1, M2, M3. An operating and indicating unit 9 also permits e.g. a continuous control of the edge errors X1, X2, Y3 which occur, as well as the determination and statistical evaluation of the operating data.

FIG. 6a shows in side view and FIG. 6b in a view from above a register draw-in device, which takes the sheet from a feeder 3, correctly orients it and then transfers it in a faultless desired position to the gripper beam 8 for further processing in a printing or embossing machine 1. The sheet 5 is conveyed by a belt as a conveying device 14 to the front stops A1, A2, where detectors D1, D2 detect sheet arrival. These detectors can be equipped e.g. with precisely set photocells, generally with optoelectronic or electromechanical elements. The position sensors S1, S2, S3 are here fitted to a foldable frame 13, on which they are set and fixed in the X and Y direction in adjustable, precise manner with respect to the associated print marks P1, P2, P3 of a faultless reference sheet. The front stops A1, A2 with the detectors D1, D2 are here fitted to a beam 20, whose ends 21, 22 are displaceable by the control elements M1, M2 in the X direction. The control elements here comprise servomotors 23 and planar cam disks 24. The displacements on the control elements are converted by a system control 11 (FIG. 4) to the correction values X1, X2 at the stops corresponding to the geometrical arrangement, i.e. the spacings on the Y axis of print marks P1, P2 to the adjacent end 21 or 22 and the mutual spacing of the ends 21, 22. The feed or conveying elements 15, which maintain the sheet during the displacements on the stops, are in FIG. 6*a* brushes 16 on the sheet trailing edge 54 and, in FIG. 6*b*, suction wheels 18 upstream of the stops. Corresponding to the sheet thickness, the feed force is so adjusted that the sheet securely engages on the stops, but is not compressed. On the beam 20, the stops A1, A2 can also be mechanically adjustable and fixable in the Y direction.

FIG. 7 shows a lateral displacement construction in which the side stop A3 can be constructed either as a slider 19 for drawing the sheet in the Y direction as shown acting on the left-hand sheet edge 52 or as a true stop 28 for pushing as shown acting on the right-hand sheet edge 53. The control element is constituted by a servomotor 23, which by means of a splined shaft 26 drives cylinder cam disks 25 displaceable thereon. The sheet is held during drawing on the slider 19 by a holding element 32, which can be pressed by a pneumatically movable push rod 17. This holding element 32 is also controlled and operated by the system control 11.

FIG. 8 shows a printing and embossing press 1 with a feeder 3, a register station 10 according to the invention, a press 2 and a taker 4. A gripper beam 8 grips the sheet 5 in the correct, faultless desired position and supplies it to the press 2. A panel 9 also contains displays and operating elements for the register draw-in and correcting device 10.

The inventive register draw-in and correcting device for sheet printing and embossing machines with leading edge stops and side stop or side sliding plate has position sensors S1, S2, S3 for detecting print marks P1, P2, P3 of the sheet 5, as well as two detectors D1, D2 associated with the front stops A1, A2 for detecting the sheet leading edge 51. The front stops A1, A2 are adjustable by control elements M1, M2 until the front print marks P1, P2 of the sheet are detected by corresponding sensors S1, S2. Thus, in particular sloping leading edges with angular errors W are perfectly corrected. A control element M3 subsequently adjusts the side stop or sliding plate A3 to the extent that the side print mark P3 is detected by the associated position sensor S3. A system control 11 controls this register correction with the position sensors S1, S2, S3, the detectors D1, D2 and the control elements M1, M2, M3.

Thus, in a very simple manner a reliable automatic register correction for each individual sheet and consequently constant, maximum print quality is obtained.

We claim:

1. A register draw-in device for sheet printing and embossing machines comprising the combination of a mounting support (12) along a path of entry of a sheet having a print image (6);

a plurality of position sensors (S1, S2, S3) attached to said mounting support for detecting print marks (P1, P2, P3) on said entering sheet, a front two of said position sensors positioned to identify front print marks (P1, P2) defining a leading edge of said print image, and a third position sensor identifying a side edge of said print image;

two front stops (A1, A2) and two detectors (D1, D2) for detecting entry of a leading edge (51) of said sheet, said front stops (A1, A2) being adjustable in a primary direction of sheet movement;

two control elements (M1, M2) for controlling the adjustment of said stops until said front print marks (P1, P2) are detected by said front two position sensors;

a side stop (A3) movable to adjust said sheet laterally relative to said primary direction of sheet movement;

a third control element (M3) for controlling adjustment of said side stop and sheet until said side print mark (P3) is detected by said third position sensor (S3); and a system control connected to said detectors (D1, D2) and said sensors (S1, S2, S3) to control operation of said control elements (M1, M2, M3).

2. A device according to claim 1 wherein said mounting support comprises a foldable frame and said position sensors are adjustable on said frame.

3. A device according to claim 1 and comprising a beam (20) extending generally transversely of said primary direction of sheet movement and supporting said front stops (A1, A2), said two control elements, opposite ends of said beam being coupled to and movable by said control elements (M1, M2) for adjusting the positions of said front stops.

4. A device according to claim 1 wherein said control elements (M1, M2, M3) comprise servomotors.

5. A device according to claim 1 wherein said control elements comprise cam disks.

6. A device according to claim 1 wherein said position sensors comprise photocells.

7. A device according to claim 1 wherein said detectors comprise photocells.

8. A device according to claim 1 wherein said detectors are attached to said front stops.

9. A device according to claim 1 wherein said third control element for controlling adjustment of said side stop comprises a servomotor (23), a transversely mounted splined shaft (26) driven by said servomotor, and a cylinder cam disk (25) carried by and movable along said splined shaft and coupled to said side stop.

10. A device according to claim 1 and including feed elements (15) which hold a sheet against said stops during sheet movements with a force appropriate to thickness of the sheet.

11. A device according to claim 10 wherein said feed elements comprise brushes (16), rolls (17) or suction wheels (18).

12. A device according to claim 10 wherein said stops and said feed elements move said sheet in said primary direction of movement into a desired position (P1S, P2S).

13. A device according to claim 1 wherein said front stops (A1, A2) push said sheet in a direction counter to said primary direction of motion into a desired position (P1S, P2S).

14. A device according to claim 1 wherein said side stop (A3) pulls said sheet in a direction transverse to said primary direction of motion into a desired position (P3S).

15. A device according to claim 1 wherein said side stop (A3) pushes said sheet in a direction transverse to said primary direction of motion into a desired position (P3S).

16. A device according to claim 1 wherein said control elements move said stops (A1, A2, A3) in accordance with a predetermined braking ramp (40) into register error-corrected desired positions (P1S, P2S, P3S) defined by said print marks.

17. A device according to claim 1 wherein said control elements (M1, M2, M3) displace said stops by a predetermined basic displacement (X0, Y0) in addition to register correction displacements (X1, X2, Y3).

18. A device according to claim 17 wherein said front stops are adjustable within total displacement ranges (X4, X5) of 2 to 6 mm.

19. A device according to claim 17 wherein said side stop is adjustable within a total displacement range (Y6) of 5 to 12 mm.

20. A device according to claim 17 wherein said ranges (X1, X2, Y3) for register correction displacement are 1 to 3 mm.

21. A sheet printing and embossing machine comprising a register draw-in device (10) according to claim 1 having a control and display panel (9).

* * * * *